United States Patent [19]

Ledent et al.

[11] Patent Number: 4,705,109

[45] Date of Patent: Nov. 10, 1987

[54] CONTROLLED RETRACTING GASIFYING AGENT INJECTION POINT PROCESS FOR UCG SITES

[75] Inventors: Pierre Ledent, Tilff; Claus Sonntag, Beaufays, both of Belgium

[73] Assignee: Institution pour le Developpement de la Gazeification Souterraine, Liege, Belgium

[21] Appl. No.: 834,625

[22] Filed: Feb. 27, 1986

[30] Foreign Application Priority Data

Mar. 7, 1985 [BE] Belgium ..... 0/214614

[51] Int. Cl.[4] ..... E21B 43/243; E21B 47/06

[52] U.S. Cl. ..... 166/251; 166/50; 166/53; 166/256; 166/261; 166/295

[58] Field of Search ..... 166/50, 53, 251, 256, 166/259, 261, 288, 295; 299/2; 48/DIG. 6; 405/266, 267, 270

[56] References Cited

U.S. PATENT DOCUMENTS

| | | | |
|---|---|---|---|
| 1,987,626 | 1/1935 | Klie | 405/266 |
| 2,786,660 | 3/1957 | Alleman | 166/50 X |
| 2,823,753 | 2/1958 | Henderson et al. | 166/295 |
| 3,010,512 | 11/1961 | Hurley et al. | 166/261 X |
| 3,330,350 | 7/1967 | Maly | 166/288 |
| 3,500,934 | 3/1970 | Magnuson | 405/267 X |
| 3,927,719 | 12/1975 | Maser | 405/267 X |
| 4,031,956 | 6/1977 | Terry | 166/261 |
| 4,243,101 | 1/1981 | Grupping | 166/261 |
| 4,252,474 | 2/1981 | Botes | 405/266 |
| 4,390,067 | 6/1983 | Willman | 166/50 X |
| 4,422,505 | 12/1983 | Collins | 166/256 |
| 4,441,554 | 4/1984 | Grupping | 166/261 |
| 4,484,629 | 11/1984 | Terry | 166/259 |
| 4,573,531 | 3/1986 | Garkusha et al. | 166/259 |

*Primary Examiner*—George A. Suchfield

*Attorney, Agent, or Firm*—Karl F. Ross; Herbert Dubno

[57] ABSTRACT

The process consists of a retraction of the gasifying agent injection point achieved by gradually plugging the tubing ends either by pneumatic injection of inert granulated material with a thermosetting binder, or by closing valves set at regular intervals inside the tubings.

2 Claims, 5 Drawing Figures

CONTROLLED RETRACTING GASIFYING AGENT INJECTION POINT PROCESS FOR UCG SITES

BACKGROUND OF THE INVENTION

Underground gasification of coal deposits in the form of thin seams located at great depth involves a number of problems.

For economic reasons, it is necessary to develop large gasifiers. In the present state of the art, this implies that the gasifiers be developed from long in-seam holes.

In order to resist rock pressure, the wells must be coated solidly; the coating must not be subjected simultaneously to high temperatures and stresses resulting from the high lithostatic pressure. This requirement can be met by using conventional metallic casings if the retreating system is adopted, in which the wells are used all the time to inject gasifying agents at low temperature.

The arrangements must also ensure an intimate contact between gasifying agents and coal; this condition is essential to produce good quality gas.

U.K. Pat. No. 2004297 A describes a retreating gas-recovery method, in which close contact between gasifying agent and coal is achieved by a methodical stowing (filling) of already gasified zones, the filling material being a granulated material transported pneumatically through the wells used for gasifying agent injection.

Taking into account the large void subsisting after coal gasification, this process requires the injection of very large quantities of material and filling may prove to be very expensive.

U.S. Pat. No. 4,334,579 describes a retreating method of gas recovery, in which close contact between gasifying agent and coal is achieved without filling by effecting periodically a controlled retraction of the gasifying agent injection point so as to permanently keep a large enough quantity of coal between the gasifying agent injection point and the already gasified zones.

In one variant of this process, the gasifying agents are injected into long in-seam wells, the injection point being gradually retracted from the well end to its starting point, using a retractable or thermodegradable injection tube.

OBJECT OF THE INVENTION

The object of this invention is to provide a new process for the retraction of the gasifying agent injection point, the gasifying agent being injected into in-seam bores of great length.

SUMMARY OF THE INVENTION

This object is achieved by controlled retraction of the gasifying agent injection point distributed in one or more bore holes drilled in the seam and cased with perforated liners, in which the displacement of the gasifying agent injection point is achieved by plugging gradually the liner ends.

In the process according to the invention, therefore, the injection point retraction does not result from destruction or retraction of the tube used to inject the gasifying agent, but rather is a result of gradually plugging the tube end.

This plug maintains a high and permanent pressure difference between the inside of the gasifying agent injection tube and the area where gasification reactions develop; as a result, the gasifying agents, leaking through a series of orifices made in the injection tube wall at regular intervals, can filter through the seam over a distance of some meters, taking advantage of the higher permeability due to creeping of the coal in the areas along a seam or in the vicinity of a cavity.

The process according to the invention can be applied with two variants.

In the first variant, the gasifying agent injection tube end is gradually plugged by injections of sand or other inert granulated material with a thermosetting binder, introduced into the gasifying agent supply tube and transported pneumatically.

In a second variant, the gasifying agent tube end is gradually obturated by closing valves, set at regular intervals inside the gasifying agent injection tube. This closing is controlled by devices reacting to the temperature rise resulting from the gasification front advance.

BRIEF DESCRIPTION OF THE DRAWING

The process according to the invention is illustrated in the accompanying drawing in which.

SPECIFIC DESCRIPTION

Figure 2:
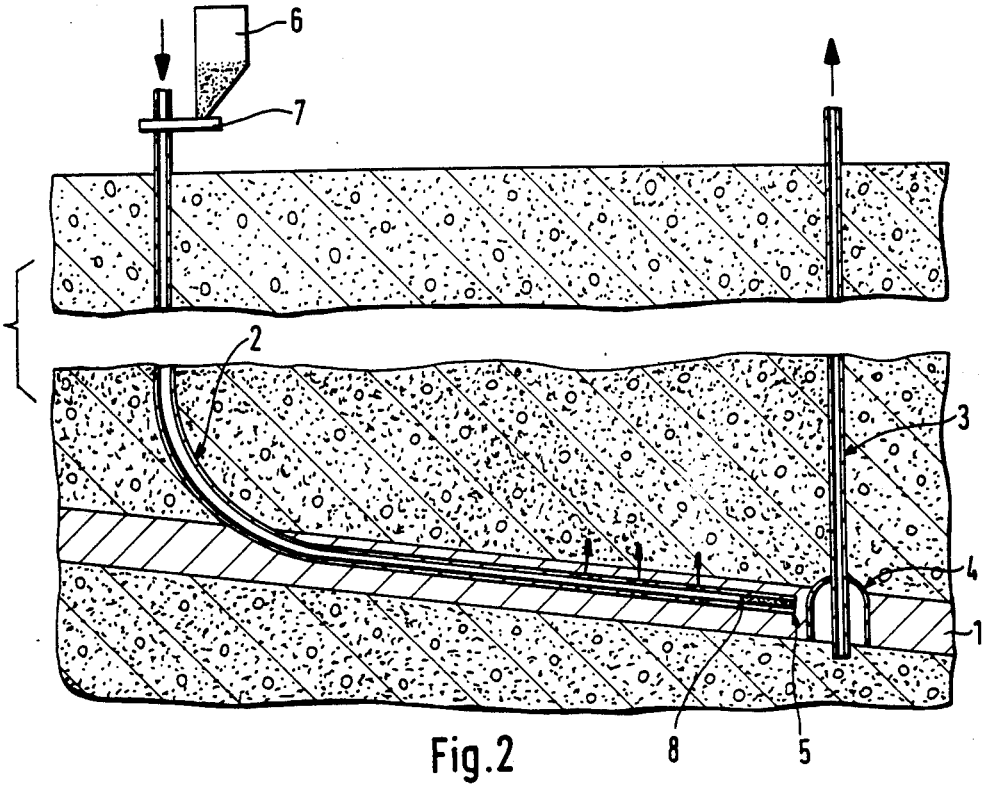
FIG. 2 is a vertical section along the line XY of FIG. 1.
Figure 1:
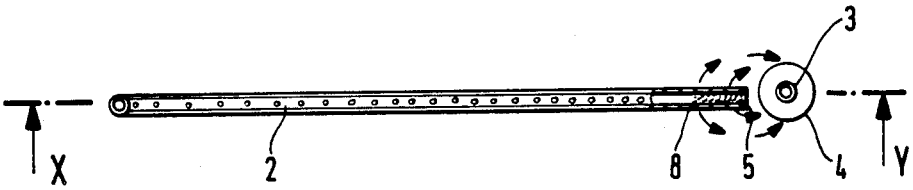
FIG. 1 is a plan view, partly broken away of a slightly dipping coal seam according to a first variant of the invention.

In FIGS. 1 and 2, seam 1, located in a virgin deposit at more than 800 m depth is intersected by deviated (angle) drilling with the bores having a large radius of curvature terminating in a straight section of 200 to 300 m length, drilled in the seam.

A vertical bore 3 intersects the same seam near the end of the bore 2.

From the surface to the roof of the seam, both bores 2, 3, are cased with casings cemented to the rocks.

The parts of the bores located in the seam are cased with perforated liners allowing the flow of the gases while preventing the creeping of the coal.

The casing at the distal end of bore 2 is plugged at 5.

Bore 2 is meant for the injection of the gasifying agents, while bore 3 serves for the recovery of the product gas.

The operation starts with the ignition of the coal by self-ignition of the coal by injection of hot air or of air enriched with oxygen or by using self-inflammable chemicals, such as silane or triethylborane.

For some days coal combustion is maintained around well 3 by alternating periods of air injection at a pressure higher than the minimum deposit-fracturing pressure, with periods of well decompression in order to evacuate combustion gases.

This creates around well 3 a rubble zone 4 of great permeability, corresponding to the void produced by coal combustion and filled up with loosened coal of the periphery and rocks falling from the seam roof.

Bores 2 and 3 are linked by combustion and gasification by injecting into well 2 a gasifying agent with oxygen such as air, a mixture of oxygen and steam or a mixture of oxygen and $CO_2$.

During this operation the pressures prevailing on the bottom of the bores 2 and 3 are controlled either by direct control or by calculation, taking into account the pressures measured at the surface, the flows and the pressure drop in both bores.

As soon as the pressure difference between the well bottom of bore 2 and the well bottom of bore 3 becomes lower than a given value (about 5 to 10 bar), the gasifying agent injection point is retracted by plugging the end of bore 2.

For this purpose, a silo under pressure 6 is installed at the surface near bore 2. This silo contains a supply of granulated material and a rotating distributor 7 to inject this granulated material into the gasifying agent flow.

The distributor starts the first injection of granulated material when the pressure difference between the bottoms of wells 2 and 3 decreases as described. This first injected quantity reaches the well bottom some ten seconds later and the distributor is put into motion again if the pressure difference has not yet reached the given value.

When this given value is reached, a certain length of the downhole part of bore 2 has been plugged with the granulated material. As a result, the gasifying agent injection point is retracted from point 5 to point 8, which corresponds to the leading end of the plugged area.

The gasifying agents move between point 8 and cavity 4 by filtration through the coal, taking advantage of the enhanced permeability resulting from the creeping of the coal, towards the empty spaces. The gasification front advances from cavity 4 in the direction opposite to the gasifying agent flow. This method ensures the production of a high quality gas, thanks to the large development of gas-solid contact surfaces and to the very uniform gasifying agent dispersion.

The granulated material distributor can be automated by using a microprocessor, the program of which can give at any instant the pressure difference prevailing between the bottoms of the wells or bores 2 and 3.

The injected granulated material is mainly made up of inert material such as sand, coryndon, or glass powder. To these products are added 20 to 30% of thermosetting material, e.g. epoxy resins or any other kind of chemical products with equivalent characteristics. This addition may be realized by mixing inert grains and plastic granulated material or by coating the inert grains with a thin coat of resin.

These products must react when the thermal wave ahead of the gasification front reaches the part of the bore in which the plugging is to be effected. Under effect of the heat, the injected granulated material will transform into a resinous concrete, adhering to the wall of the tubing into which they were injected so that the plugging of the end of the bore is not interfered with by the progression of the gasification front and the thermal destruction of the tubing end.

In the second variant of the process the well tubing is divided into elements of some meters in length in the part drilled in the seam.

Figure 3:
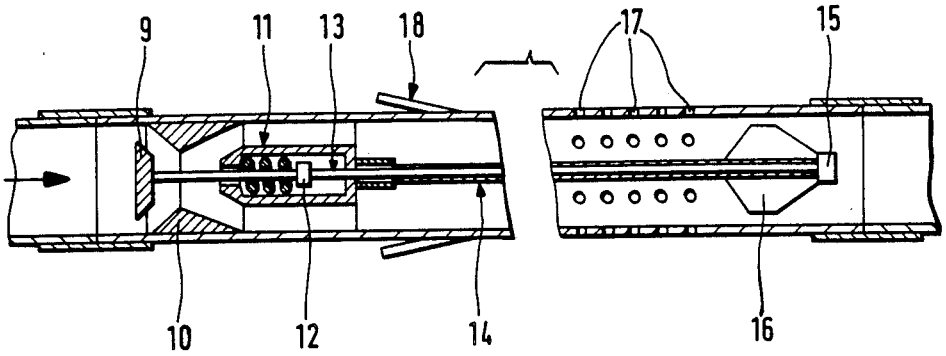
FIG. 3 is a section of a tubing element used in the second variant of the process.

FIG. 3 shows a median section of one of these elements.

At the inlet of this element, the tubing can be plugged by a movable valve head 9 which can engage a valve seat 10.

The valve is closed by the spring pressure 11, acting on valve rod 12.

If there is no temperature rise at all, the valve is kept open by rod 13 sliding in sheath 14, the motion of which is hindered by plug 15.

In the center of this plug, there is a fusible cylinder, made of a lead and tin alloy, the melting point of which is about 200° to 300° C. When the gasification front approaches plug 15, the temperature raise causes the fusible cylinder to melt. Then, rod 13 can slide freely in sheath 14, liberating the valve member 9 which can close under the effect of spring 11.

Sheath 14 is kept in the tubing axis by one or more centering elements 16.

Each tubing element is made up of a perforated part 17 and one or more packings, such as 18, made up of metallic or plastic flexible lamellae which can expand under influence of the pressure and ensure the tightness between the external tubing wall and the coal which forms the internal wall of the bore.

Figure 4:
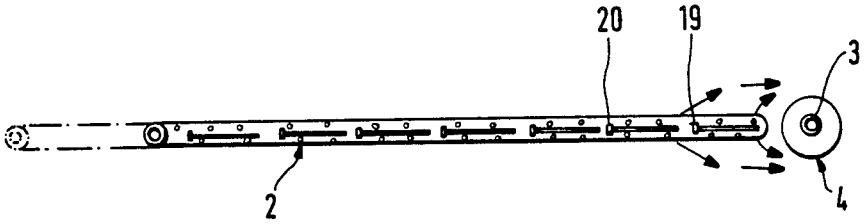
FIG. 4 is a plan view of the seam illustrating the second variant of the process.

FIG. 4 illustrates the use of the second variant of the process.

As in the first variant, the operation starts with the ignition of the coal at the bottom of bore or well 3 and with the creation around the bore of a rubble zone 4 with high permeability.

Bores 2 and 3 are linked by injecting a gasifying agent with oxygen into well 2.

At the beginning of this operation, the gasifying agent is injected into the perforated part of the last tubing element.

The heat freed by reverse combustion causes the temperature to rise in the coal in the vicinity of the reaction zone. This temperature raise spreads before the reaction and from well 3 towards well 2.

When the temperature of the gasifying agent injection tube end reaches 200° to 300° C., the fusible cylinder situated at the end of the last tubing melts, causing valve 19, located at the inlet of this element to close. From this moment on, the gasifying agent is injected into the seam by the perforated part of the penultimate tubing element.

When the temperature near valve 19 reaches 200° to 300° C., the fusible cylinder located at the end of the penultimate tubing end melts in its turn and causes the closing of valve 20.

Thanks to the repetition of this process, the gasifying agent injection point is kept at any time, some meters upstream of the gasification front, ensuring the gasifying agent flux dispersion by filtration through the coal.

Figure 5:
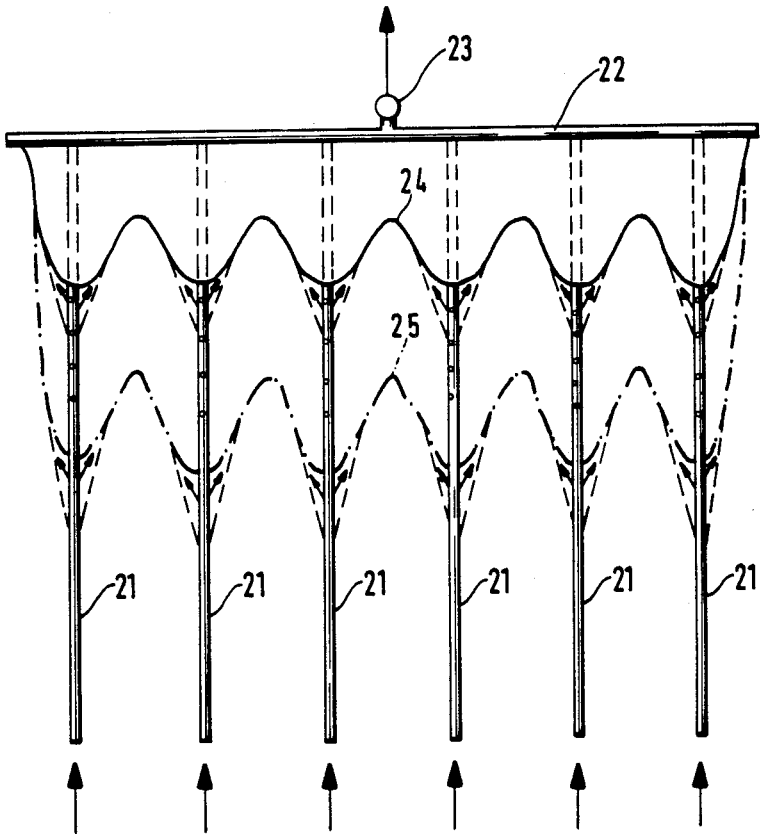
FIG. 5 is another plan view of the seam illustrating either variant of the process, for recovery of gas from large panels of coal.

FIG. 5 shows the use of the process according to the invention, to recover gas from a wide seam.

To prepare this seam, a number of parallel bores 21 are drilled in the seam, 20 to 30 m apart from each other, and a drift 22 is connected to the gas discharge bore 23. This preparatory work starts from underlying drifts and is done by the method described in British Pat. No. A 2.086.930 or from the surface by the deviated drilling technique. The gas generator is ignited over the whole length of drift 22.

The gasifying agent is injected simultaneously into all the bores 21; each bore is equipped with an injection device for granulated material or with a series of valves for the controlled retraction of the injection point.

Gasification causes the gradual widening of drift 22 and the displacement of the gasification front in the opposite direction of the gasifying agent flow.

The rock pressure wave moving before the gasification front causes the gradual collapse of the coal pillars separating the bores 21, which leads to a gradual widening of the coal zones through which the gasifying agent is filtered.

Curves 24 and 25 show two successive positions of the gasification front with the corresponding injection points.

If it is compared to the process used previously to make a controlled retraction of the gasifying agent injection point, the process according to the invention has the following advantages: it simplifies the operation of retracting the injection point, which can be fully automated and which does not interrupt the gasification process.

It allows a retraction of injection point by small successive steps, uniformly distributed in time, thus avoiding fluctuations in the product gas composition and characteristics.

It maintains a significant gas pressure difference between the injection drillings and the gasification area, thus allowing the dispersion of the gasifying agent by filtration through the coal mass. Consequently, there is a very close contact between gases and solids, favoring the production of high quality gas.

We claim:

1. In a process for the underground gasification of coal, wherein a gasification agent is introduced through at least one borehole into a coal seam and wherein gasification is effected of the coal of the seam with the gasification agent at a gasification region spaced from the point of injection, and gas produced by the gasification of said region is recovered, the improvement which comprises in combination the steps of:

(a) forming said borehole in said coal seam and lining said borehole with perforated liners forming a tubing extending to a distal end of said borehole;

(b) plugging said tubing at said distal end;

(c) introducing said gasification agent through said tubing into said coal seam so that said gasification agent passes through perforations in said liners upstream of the plugged distal end of said tubing; and (d) controlledly retracting said point along said borehole by:

($d_1$) pneumatically injecting quantities of an inert granular material together with a thermosetting binder into said tubing at a cadence such that said tubing is progessively plugged from said distal end rearwardly and said point is retracted along said borehole, and ($d_2$) controlling said cadence so as to maintain between the interior of said borehole and said region a pressure difference permitting said gasification agent to filter through the coal of said seam over a distance of meters between said point and said region.

2. The improvement defined in claim 1 wherein said inert granular material is sand, coryndon or ground glass to which 20 to 30% of an epoxy resin has been added.

* * * * *